US008095026B2

(12) United States Patent
Maeyama et al.

(10) Patent No.: US 8,095,026 B2
(45) Date of Patent: Jan. 10, 2012

(54) DEVELOPING DEVICE AND IMAGE FORMING APPARATUS

(75) Inventors: Takeshi Maeyama, Ikeda (JP); Toshiya Natsuhara, Takarazuka (JP); Junya Hirayama, Takarazuka (JP); Shigeo Uetake, Takatsuki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 395 days.

(21) Appl. No.: 12/384,037

(22) Filed: Mar. 31, 2009

(65) Prior Publication Data

US 2009/0252513 A1 Oct. 8, 2009

(30) Foreign Application Priority Data

Apr. 4, 2008 (JP) ..... 2008-098107

(51) Int. Cl.
*G03G 15/08* (2006.01)
*G03G 15/09* (2006.01)

(52) U.S. Cl. ..... 399/55; 399/270; 399/285

(58) Field of Classification Search ..... 399/55, 399/273, 270, 283, 285
See application file for complete search history.

(56) References Cited

U.S. PATENT DOCUMENTS

| | | | | |
|---|---|---|---|---|
| 5,832,350 | A * | 11/1998 | Kumasaka et al. | 399/285 X |
| 7,340,203 | B2 * | 3/2008 | Hollig et al. | 399/273 |
| 2007/0071505 | A1 * | 3/2007 | Do | 399/270 |
| 2008/0219712 | A1 * | 9/2008 | Hirayama et al. | 399/285 |
| 2009/0067890 | A1 * | 3/2009 | Maeyama et al. | 399/273 |
| 2009/0103957 | A1 * | 4/2009 | Hirayama et al. | 399/285 |

FOREIGN PATENT DOCUMENTS

| | | |
|---|---|---|
| JP | 05-150636 | 6/1993 |
| JP | 10-319708 | 12/1998 |
| JP | 2007-034098 | 2/2007 |

* cited by examiner

*Primary Examiner* — Sophia S Chen
(74) *Attorney, Agent, or Firm* — Brinks Hofer Gilson & Lione

(57) ABSTRACT

A developing device and image forming apparatus are provided, wherein high quality images, in which generation of development hysteresis (ghost image) is alleviated, are obtained over a long period using a hybrid development method including a toner-supplying developer supporting member and a toner-collecting developer supporting member. Bias voltage is applied in the direction in which the toner is supplied to the toner supporting member in the toner supply region and the toner collection region of the toner-supplying developer supporting member and the toner-collecting developer supporting member respectively so that the toner collecting capability in the toner collection region is higher than the toner collecting capability in the toner supply region.

6 Claims, 4 Drawing Sheets

DEVELOPING DEVICE AND IMAGE FORMING APPARATUS

This application is based on Japanese Patent Application No. 2008-098107 filed on Apr. 4, 2008, in Japanese Patent Office, the entire content of which is hereby incorporated by reference.

TECHNICAL FIELD

The present invention relates to a hybrid developing device that uses a developer including a carrier and a toner and comprises: a toner-supplying developer supporting member for supplying toner to a toner supporting member; a toner supporting member for developing an electrostatic latent image with the supplied toner; and a toner-collecting developer supporting member for collecting post-development residual toner from the toner supporting member. The present invention also relates to an image forming apparatus equipped with this hybrid developing device.

BACKGROUND

Conventionally, the mono-component development method which uses only a toner as the developer and the dual component development method which uses a toner and a carrier have been known as development methods in image forming apparatuses using the electro-photography system.

The mono-component development method is advantageous in terms of simplicity, compactness, and low cost of the apparatus. However, toner deterioration can be accelerated by the strong stress on the regulating section that charges the toner, and the charge-accepting ability of the toner thereby can be to decrease. Furthermore, because the surfaces of the toner regulating member and of the toner-supporting member can be contaminated with the toner and external additives, the ability to charge toner can be reduced and the life-span of the developing device is accordingly shortened.

In the dual component development method, because toner is charged by triboelectric charging caused by being mixed with carrier, the stress is smaller and this is advantageous against toner deterioration. Furthermore, because the surface area of carrier is large, the carrier is relatively resistant to contamination of toner and external additives, and this is advantageous in extending the life-span.

However, in the dual-component development method, when the latent electrostatic image on the image supporting member is being developed, the surface of the image supporting member is rubbed with the magnetic brush of the developer, and thus a trace of a magnetic brush impressions can be generated. Furthermore, the carrier tends to attach to the image supporting member and thus causing a problem of image defects.

A hybrid developing method has been disclosed (Refer to Unexamined Japanese Patent Application Publication No. H 05-150636) to maintain a long life-span of the two component development, where development is performed with only toner which is supplied to the toner supporting member from a dual-component developer supported on the developer supporting member.

However, the hybrid development method is problematic in that the post-development residual toner, on the toner supporting member, that has not been used in development appears on the image as development hysteresis (ghost image) in the subsequent development process. This is caused by insufficient toner collecting capability of the developer supporting member stemming from applying a bias to the developer supporting member so as to put a priority on supplying the toner to the toner supporting member.

In recent years, in order to solve this problem i, a method has been proposed in which the toner-collecting developer supporting member to which a voltage for collecting the post-development residual toner is applied is added in the hybrid development method (Unexamined Japanese Patent Application Publication No. H 10-319708). In the method described in Unexamined Japanese Patent Application Publication No. H 10-319708, the problem of development hysteresis does not occur in the beginning because the post-development residual toner on the toner supporting member is surely collected by the toner-collecting developer supporting member.

However, in this method, because a voltage is continuously applied to the toner-collecting developer supporting member to attract toner in the direction thereto, the toner in the developer is separated from the carrier and transferred to the surface of the toner-collecting developer supporting member, and thereby causing uneven distribution.

In this state where the toner is unevenly (much) distributed on the surface of the toner-collecting developer supporting member, when the developer is removed from the toner-collecting developer supporting member, the unevenly toner is not removed and remains on the surface of the toner-collecting developer supporting member. As a result, a long time use causes toner to accumulate on the toner-collecting developer supporting member.

The accumulation of charged toner reduces the electric field for collection in the toner collection region, and the toner collecting capability is thus reduced. As a result, the collecting capability which was initially sufficient is not sustained, and problematic ghost-image generation occurs with repeated image formation.

As another solution, in order to solve the problem of the ghost-image generation, a method has been proposed in which multiple toner-supplying developer supporting members are used in succession to supply a large amount of toner to the toner supporting member (Unexamined Japanese Patent Application Publication No. 2007-34098).

However, also in this method, collection of the post-development residual toner was insufficient, and the method cannot be considered appropriate as a measure for dealing with the problem of ghost images.

As described above, technological improvements have been carried out in order to deal with ghost-image generation in the hybrid development method, but no technology has been proposed to satisfactorily meet the requirement.

SUMMARY

In view of forgoing, one embodiment according to one aspect of the present invention is a developing device, comprising:

an developer container for containing developer including toner and carrier;

a toner-supplying developer supporting member for supporting on a surface thereof the developer in the developer container to convey the developer;

a toner supporting member for supporting toner received from the toner-supplying developer supporting member and conveying the toner to develop an electrostatic latent image on an image supporting member;

a toner-collecting developer supporting member for collecting a post-development residual toner from the toner supporting member;

a first bias power supply for applying a first bias voltage to the toner-collecting developer supporting member to form a first bias electric field between the toner-collecting developer supporting member and the toner supporting member in a direction in which toner is transferred to the toner supporting member; and a second bias power supply for applying a second bias voltage to the toner-supplying developer supporting member to form a second bias electric field between the toner-supplying developer supporting member and the toner supporting member in a direction in which toner is transferred to the toner supporting member, wherein a toner collecting capability for the toner-collecting developer supporting member to collect toner from the toner supporting member is higher than a toner collecting capability for the toner-supplying developer supporting member to collect toner from the toner supporting member.

According to another aspect of the present invention, another embodiment is an image forming apparatus, comprising:

an image supporting member for supporting an electrostatic latent image thereon; and an developer container for containing developer including toner and carrier;

a toner-supplying developer supporting member for supporting on a surface thereof the developer in the developer container to convey the developer;

a toner supporting member for supporting toner received from the toner-supplying developer supporting member and conveying the toner to develop an electrostatic latent image on the image supporting member;

a toner-collecting developer supporting member for collecting a post-development residual toner from the toner supporting member;

a first bias power supply for applying a first bias voltage to the toner-collecting developer supporting member to form a first bias electric field between the toner-collecting developer supporting member and the toner supporting member in a direction in which toner is transferred to the toner supporting member; and a second bias power supply for applying a second bias voltage to the toner-supplying developer supporting member to form a second bias electric field between the toner-supplying developer supporting member and the toner supporting member in a direction in which toner is transferred to the toner supporting member, wherein a toner collecting capability for the toner-collecting developer supporting member to collect toner from the toner supporting member is higher than a toner collecting capability for the toner-supplying developer supporting member to collect toner from the toner supporting member.

DETAILED DESCRIPTION OF THE PREFERRED EMBODIMENTS

The embodiments of the present invention will be described in the followings with reference to the drawings.

(Structure and Operation of the Image Forming Apparatus)

Figure 1:
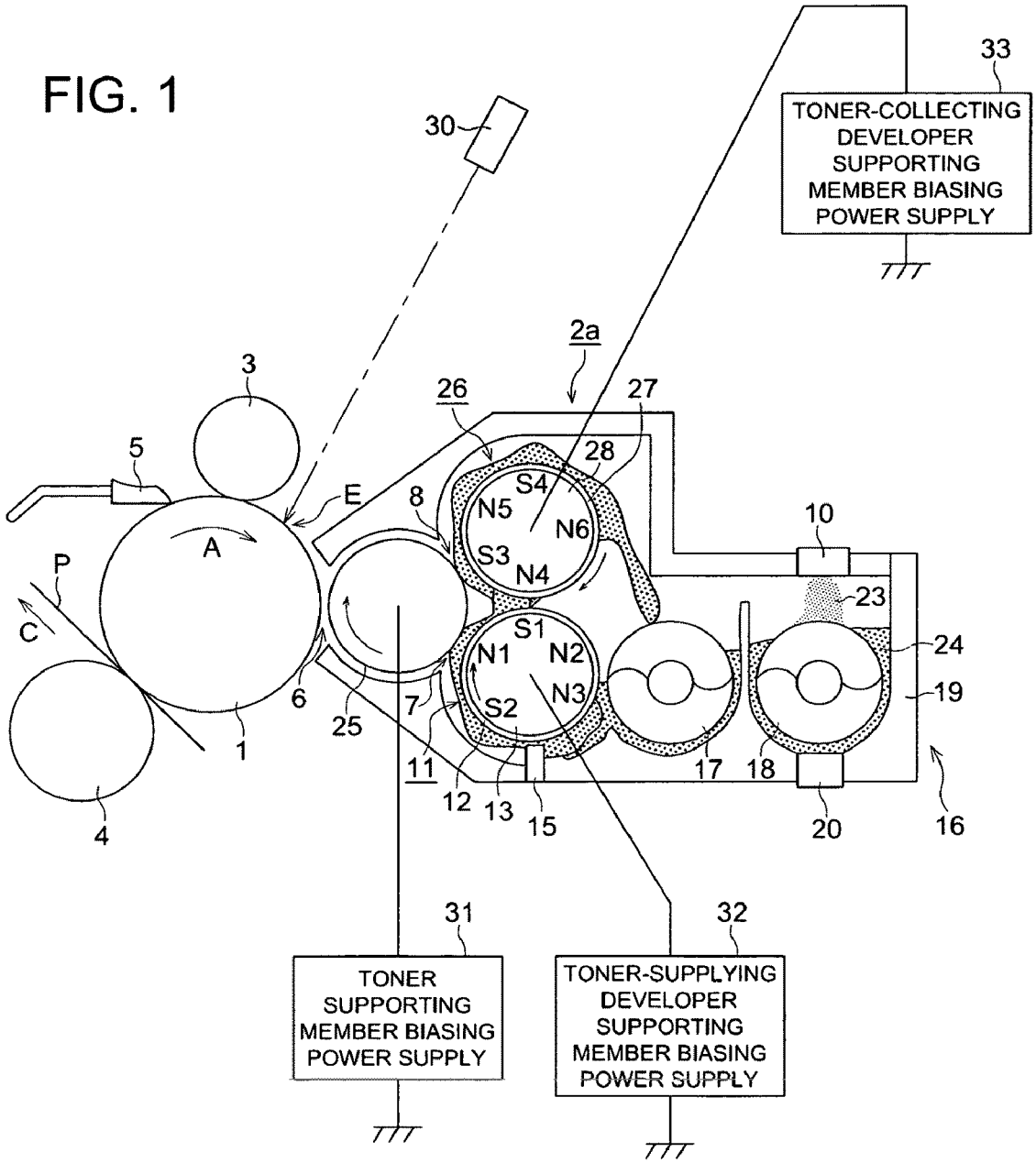
FIG. 1 is a diagram showing a cross-section of an example of the structure of the main part of a developing device 2*a* according to the first embodiment of the present invention and the image forming apparatus including the developing device 2*a;*

FIG. 1 shows an example of the structure of the main parts of an image forming apparatus according to the first embodiment of the present invention. The schematic structure and operation of the image forming apparatus will be described with reference to FIG. 1.

This image forming apparatus is a printer in which the toner image is formed on the image supporting member (photoreceptor) 1 by an electrophotographic method, and is transferred to a transfer medium P such as paper, and image formation is thus carried out.

This image forming apparatus includes an image supporting member 1 for supporting an electrostatic latent image, and the following components are arranged around the image supporting member 1 in the rotational direction A thereof in this order: a charging member 3 for charging the image supporting member 1; a developing device 2*a* for developing electrostatic latent images on the image supporting member 1; a transfer roller 4 for transferring toner images on the image supporting member 1; and a cleaning blade 5 for cleaning residual toner on the image supporting member 1.

The image supporting member 1 is charged by the charging member 3, and then exposed at position E in the figure by an exposure device 30 which has a laser emitting device or the like, and an electrostatic latent image is formed on that surface. The developing device 2*a* develops this electrostatic latent image to forms a toner image. The transfer roller 4 transfers the toner image on the image supporting member 1 onto a transfer medium P and then discharges it in the direction of arrow C in the figure. The cleaning blade 5 removes the residual toner on the image supporting member 1 after transfer by a mechanical force.

Any known electrophotographic technology can be used for the image supporting member 1, the charging member 3, the exposure device 30, the transfer roller 4, the cleaning blade 5 and the like incorporated in the image forming apparatus. For example, a charging roller is employed as the charging member 3 in the figure, but it may be replaced by a charging device which does not come in contact with the image supporting member 1. Further, the cleaning blade may be omitted.

Next, an example of the structure of the developing device 2*a* of the hybrid development method according to the present embodiment will be described.

The developing device 2*a* includes the following components: a developer tank 16 for storing developer 24 which includes toner and carrier; a toner-supplying developer supporting member 11 which supports the developer 24 supplied from the developer tank 16 on its surface and then conveys the developer 24; a toner supporting member 25 which receives toner supplied from the toner-supplying developer supporting member 11 in a toner supply region 7 and develops an electrostatic latent image formed on the image supporting member 1; and a toner-collecting developer supporting member 26 which collects, in a toner collecting region 8, post-development residual toner remaining on the toner supporting member 25 after the toner passing through the developing region 6.

The developing device 2*a* includes a toner-supporting member biasing power supply 31 for supplying voltage to the toner supporting member 25; a toner-supplying developer supporting member biasing power supply 32 for supplying voltage to the toner-supplying developer supporting member 11; and a toner-collecting developer supporting member biasing power supply 33 for supplying voltage to the toner-collecting developer supporting member 26.

The structure and operation of the developing device 2*a* will be described in detail in the followings.

(Developer Composition)

The composition of the developer used in the developing device of the embodiment will be described in the followings.

The developer 24 used in the embodiment includes a toner and a carrier for charging the toner.

<Toner>

There are no particular limitations imposed on the toner, and generally used known toners may be used. A toner may be used in which a binder resin is added with a colorant, and a charge control agent and a mold release agent if necessary, and is processed with an external additive. The toner particle diameter is preferably about from 3 to 15 μm, but is not limited thereto.

This type of toner may be manufactured by generally used known methods that are generally used. For example, the toner may be manufactured by methods such as pulverization, emulsion polymerization, and suspension polymerization.

Examples of the binder resin used in the toner include, but are not limited to styrene resins (homopolymer or copolymer including styrene or a styrene substitute), polyester resin, epoxy resin, vinyl chloride resin, phenol resin, polyethylene resin, polypropylene resin, polyurethane resin, silicone resin and the like. Depending on the individual resins and the combination of these resins, those having a softening temperature in the range of from 80 to 160° C. and a glass transition temperature in the range of from 50 to 75° C. are preferable.

As the colorant may be used a generally used known colorant, for example, carbon black, aniline black, activated carbon, magnetite, benzene yellow, permanent yellow, naphtol yellow, phthalocyanine blue, first sky blue, ultramarine blue, rose bengal, lake red and the like, and generally the amount used is preferably from 2 to 20% by mass of the binder resin.

As the charge control agent may be used any known charge control agent, and examples of the charge control agent for the positively charging toners include nigrosine dyes, quaternary ammonium chloride compounds, tri phenyl methane compounds, imidazole compounds, and polyamine resins. Examples of the charge control agent for negatively charging toners include azo dyes containing metals such as Cr, Co, Al, Fe, metal salicylate compounds, metal alkyl salicyclate compounds, calixarene, and the like. Generally the amount of the charge control agent used is preferably from 0.1 to 10% by mass of the binder resin.

As the release agent may be used any generally used known release agent, and one of or combination of the following agents can be used: polyethylene, polypropylene, carnauba wax, and Sasol wax. Generally, the release agent is preferably used by from 0.1 to 10% by mass of the binder resin.

As the external additive may be used any generally used known external additive such as a fluidity enhancer, for example, fine inorganic particles including silica, titanium oxide, and aluminum oxide; and fine particles of resins including acrylic resin, styrene resin, silicone resin, and fluorine resin. In particular, external additives that have been hydrophobized using silane coupling agents, titanium coupling agents or silicone oil, are preferably used. These fluidity enhancers are added by from 0.1 to 5% by mass of the toner. The number average primary particle diameter of the external additive is preferably from 10 to 100 nm.

In addition, the external additive may be opposite polarity particles having the opposite polarity charge to that of the toner. The opposite polarity particles may be appropriately selected based on the toner charge polarity and be preferably used.

In the case where a negative polarity toner is used, fine particles that are to be positively charged are used as the opposite polarity particles, and examples include inorganic particles such as strontium titanate, barium titanate, alumina and the like; particles made of thermoplastic resins or thermosetting resins such as acrylic resin, benzoguamine resin, nylon (registered trademark) resin, polyimide resin, polyamide resin and the like. Also a positive charge control agent that provides positive charge may be included in a resin and it is also possible to form a copolymer with a nitrogen-containing monomer.

As the above-mentioned positive charge control agent, may be used, for example, nigrosine dye and quaternary ammonium salts and the like. AS the nitrogen-containing monomer, may be used 2-dimethyl amino ethyl acrylate, 2-diethyl amino ethyl acrylate, 2-dimethyl amino ethyl metacrylate, 2-diethyl amino ethyl metacrylate, vinylpyridine, N-vinylcarbazole, vinylimidazole and the like.

On the other hand, in the case where a positive polarity toner is used, as opposite polarity fine particles may be used fine inorganic particles such as silica, titanium oxide and the like as well as, fine particles formed from thermosetting resins or thermoplastic resins such as resins containing fluorine, polyolefin resins, silicone resins, polyester resins and the like. Also a negative charge control agent that provides a negative charge may be included in the resin or a copolymer with a fluorine based acrylic monomer or a fluorine based metacrylic monomer. Examples of the negative charge control agent that may be used include salicylic acid or naphtole chrome complexes, aluminum complexes, iron complexes, zinc complexes and the like.

In order to control the charge and hydrophobocity of the opposite polarity particles, the surface of the inorganic particles may be subjected to surface processing using a silane coupling agent, a titanium coupling agent, silicone oil and the like. In particular, in the case of providing a positive charge to the inorganic particles, the surface processing is preferably done using coupling agents having an amino radical, and in the case of providing a negative charge, the surface processing is preferably done using coupling agents having a fluorine radical.

The number average particle diameter of the opposite polarity particles is preferably from 100 to 1000 nm. The opposite polarity particles is added by from 1 to 10% by mass of the toner.

<Carrier>

No particular limitation is imposed on the carrier, and generally used known carriers may be used. A binder carrier or a coated carrier may be used. The particle diameter of the carrier is preferably from 15 to 100 μm but is not limited thereto.

The binder carrier is a carrier in which magnetic particles are dispersed in a binder resin, and charging fine particles of positive or negative polarity may be provided on the carrier surface and a surface coating layer may also be provided on the carrier. The charge properties such as polarity and the like of the binder carrier can be controlled by the binder resin material, the charging fine particles, and the type of surface coating layer.

Examples of the binder resin which is used as the binder type carrier include polystyrene resins such as vinyl resins; thermoplastic resins such as polyester resins, nylon resins, and polyolefin resins; and thermosetting resins such as phenol resins.

Examples of the magnetic particles for the binder carrier include spinel ferrites such as magnetite, gamma ferric oxide and the like; spinel ferrites including one or two non-ferrous metals (Mn, Ni, Mg, Cu and the like); magnetic plumbite ferrites such as barium ferrite; and particles of iron or alloys having an oxide layer on the surface. The shape of these particles may be spherical or needle-shaped. In the case where high magnetism is required, iron based ferromagnetic particles are preferably used. In terms of chemical stability, ferromagnetic particles such as spinel ferrites including magnetite and gamma ferric oxide; magnetic plumbite ferrites such as barium ferrite may be used. By suitably selecting the type and the amount of the ferromagnetic particles, a magnetic resin carrier having the desired magnetization can be obtained. The magnetic particles should be added to the magnetic resin carrier by from 50 to 90% by mass.

As the surface coating material for the binder carrier, may be used Silicone resin, acrylic resin, epoxy resin, fluorine resins and the like, and the charge providing ability is improved by coating these resins on the surface of the binder carrier and hardening the coated layer.

Fixing the charging fine particles or the conductive fine particles to the surface of the binder carrier may be carried out, for example, by uniformly mixing the magnetic resin carrier and the fine particles to attach the fine particles to the surface of the magnetic resin carrier and then applying a mechanical or thermal impact to them to drive and fix the fine particles in the magnetic carrier. In this case, the fine particles are not completely buried in the magnetic resin carrier, but rather fixed with a portion thereof protruded from the surface of the magnetic resin carrier.

As the charging fine particles, organic and inorganic insulating materials may be used. The following examples of the organic insulating particles may be specifically used: polystyrene, styrene copolymers, acrylic resins, various acrylic copolymers, nylon, polyethylene, polypropylene, fluorine resins and bridged compounds thereof. The desired level of charge and polarity can be obtained by appropriately selecting the material, polymerization catalyst, surface processing and the like. The following examples of the inorganic particles may be used: silica and titanium dioxide as negatively charging particles, and strontium titanate and alumina as negatively charging particles.

On the other hand, the coated carrier is a carrier in which a carrier core particle formed of magnetic materials are coated with resins, and as in the case of the binder carrier, positively or negatively charging particles also can be fixed to the carrier surface. Charging properties of the coating resin such as polarity and the like can be controlled depending on the type of the surface coating layer and the charged particles, and the same materials as in the case of the binder carrier may be used. In particular, the coating resin can be the same resins as those used for the binder resin of the binder carrier.

The mixing ratio of the toner to the carrier may be adjusted in order to obtain the desired toner charge amount, and the mixing ratio of toner to the total amount of the toner and the carrier from 3 to 50% by mass is appropriate, and the ratio from 6 to 30% is more appropriate.

(Structure and Operation of the Developing Device 2*a*)

A detailed example of the structure and operation of the developing device 2*a* according to the embodiment will be described with reference to FIG. 1.

<Structure of Device>

As described above, the developer 24 used in the developing device 2*a* is formed of a toner and a carrier and is stored in the developer tank 16.

The developer tank 16 is formed of a casing 19, and mixing/stirring members 17 and 18 are normally stored inside. The mixing/stirring members 17 and 18 stir and mix the developer 24 and supply the developer 24 to the toner-supplying developer supporting member 11. An ATDC (Automatic Toner Density Control) sensor 20 is preferably provided at the position opposing the mixing/stirring member 18 in the casing 19.

The developing device 2*a* is usually equipped with a replenishing section 10 for replenishing the developer tank 16 with toner of the amount consumed in the development region 6. The replenishing section 10 supplies the developer tank 16 with the replenishing toner 23 fed from the hopper (not shown) storing the replenishing toner 23. The replenishing operation may be controlled based on the output from the ATDC sensor 20.

The developing device 2*a* also has a control member (control blade) 15 for making the developer layer thin and controlling the amount of the developer on the toner-supplying developer supporting member 11.

The toner-supplying developer supporting member 11 includes a fixed magnetic roller 13 and a rotatable sleeve roller 12 which encircles the fixed magnetic roller 13, and at the time of image formation a toner supply bias for supplying toner to the toner supporting member 25 is applied by the toner-supplying developer supporting member biasing power supply 32.

The magnetic roller 13 has five magnetic poles N1, S1, N2, N3, and S2, along the direction of rotation of the sleeve roller 12. Of these magnetic poles, the primary magnetic pole N1 is arranged at the position corresponding to the toner supply region 7 which opposes the toner supporting member 25.

Similarly, the toner-collecting developer supporting member 26 includes a fixed magnetic roller 28 and a rotatable sleeve roller 27 which encircles the fixed magnetic roller 28, and is applied, by the toner-collecting developer supporting member biasing power supply 33, with a toner collection bias for collecting the post-development residual toner on the toner supporting member 25.

The magnetic roller 28 has 5 magnetic poles N4, S3, N5, S4, and N6 along the direction of rotation of the sleeve roller 27. Of these magnetic poles, the primary magnetic pole S3 is arranged at the position corresponding to the toner collecting region 8 which opposes the toner supporting member 25.

The homopolar sections N6 and N4 which generate repelling magnetic fields for stripping the developer 24 on the surface of the sleeve roller 27 are arranged facing the inside of the developer tank 16.

Furthermore, in the developing device 2*a*, the S1 pole and N4 pole are arranged opposing each other in the toner-supplying developer supporting member 11 and the toner-collecting developer supporting member 26 respectively, in order to transfer the developer 24 on the surface of the toner-supplying developer supporting member 11 to the toner-collecting developer supporting member 26. The developer 24 is transferred from the S1 magnetic pole side of the toner-supplying developer supporting member 11 to the N4 magnetic pole side of the toner-collecting developer supporting member 26 and then conveyed.

The toner supporting member 25 is arranged opposing the toner-supplying developer supporting member 11, the toner-collecting developer supporting member 26, and the image supporting member 1, and a development bias for developing the electrostatic latent image on the image supporting member 1 is applied by the toner-supporting member biasing power supply 31.

The toner supporting member 25 may be formed of any material provided that the abovementioned voltage can be applied, and an example is an aluminum roller with its surface having been subjected to surface processing such as alumite treatment or the like. In addition, the toner supporting member 25 may be formed of a conductive substrate such as aluminum with the following coatings: resin coating such as a coating of polyester resin, polycarbonate resin, acrylic resin, polyethylene resin, polypropylene resin, urethane resin, polyamide resin, polyimide resin, polysufone resin, polyethyl ketone resin, vinyl chloride resin, vinyl acetate resin, silicone resin, and fluorine resin; or a rubber coating of silicone rubber, urethane rubber, nitryl rubber, natural rubber, isoprene rubber and the like.

A conducting agent may be added to the bulk or to the surface of the aforementioned coating. The conducting agent may be an electron conductive agent or an ion conductive agent. Examples of the electron conductive agent include, without being limited thereto, carbon blacks such as Ketzin black, acetylene black, furnace black; and metal powders and metal oxide particles. Examples of the ion conducting agent include, without being limited thereto, cationic compounds such as quaternary ammonium chloride; amphoteric compounds; and other ionic polymer materials. Furthermore, a conductive roller formed from a metal material such as aluminum or the like may be used.

<Operation of the Device>

An example of the operation of the developing device 2*a* will be described in detail with reference to FIG. 1.

The developer 24 inside the development tank 16 is stirred and mixed and circulatingly conveyed in the developer tank 16 by the rotation of the mixing/stirring members 17 and 18 while triboelectric charging is done. The developer 24 is supplied to the sleeve roller 12 of the toner-supplying developer supporting member 11.

The developer 24 is held on the surface of the sleeve roller 12 by the magnetic force of the magnetic roller 13 inside the toner-supplying developer supporting member 11 and rotatingly moves along with the sleeve roller 12, and its passing amount is regulated by the regulation member 15 provided opposing the toner-supplying developer supporting member 11.

Subsequently, the developer 24 is conveyed to the toner supply region 7 where the toner-supplying developer supporting member 11 opposes the toner supporting member 25.

The bristle of developer is formed by the magnetic force of the primary magnetic pole N1 of the magnetic roller 13 in the toner supply region 7, and the electric field generated by the development bias applied to the toner supporting member 25 and the toner supply bias applied to the toner-supplying developer supporting member 11 causes the toner in the developer 24 to be transferred to the toner supporting member 25 side.

In a general manner, the toner supporting member 25 is applied with a bias in which an alternating current voltage is superimposed on a direct current voltage, and the toner-supplying developer supporting member 11 is applied with only a direct current voltage or a bias in which an alternating current voltage is superimposed on a direct current voltage. Thus, an electric field in which an alternating current electric field is superimposed on a direct current electric field is formed at the toner supply region 7 is formed as a toner-supplying electric field.

The toner layer transferred to the toner supporting member 25 by this toner-supplying electric field is conveyed to the developing region 6 by the rotation of the toner supporting member 25, is transferred, assisted by a development field formed by the development bias and the potential of the latent image, onto the image supporting member 1, and the latent image is thus developed to be a visible image.

In the development region 6, the toner layer from which the toner has been consumed (post-development residual toner) is further conveyed to the toner collection region 8 where the toner supporting member 25 opposes the toner-collecting developer supporting member 26.

Meanwhile, the developer 24 from which toner has been supplied to the toner supporting member 25 in the toner supply region 7 is conveyed to the region opposing the toner-collecting developer supporting member 26, and then transferred to the toner-collecting developer supporting member 26 by the magnetic field formed by the magnetic pole S1 of the toner-supplying developer supporting member 11 and the magnetic pole N4 of the toner-collecting developer supporting member 26.

The developer 24 transferred to the toner-collecting developer supporting member 26 rotates along with the sleeve roller 27 of the toner-collecting developer supporting member 26 and is conveyed to the toner collection region 8 where the toner-collecting developer supporting member 26 opposes the toner supporting member 25.

In a general manner, the toner supporting member 25 is applied with a bias in which an alternating current voltage is superimposed on a direct current voltage, and the toner-collecting developer supporting member 26 is applied with only a direct current voltage or a bias in which alternating current voltage is superimposed on direct current voltage. Thus, an electric field in which an alternating current electric field is superimposed on a direct current electric field is formed in the toner collection region 8.

In the toner collection region 8, the post-development residual toner is transferred to be collected from the toner supporting member 25 to the toner-collecting developer supporting member 26 by the toner-collecting electric field.

The collection conditions such as the bias setting in the toner collection region will be described in detail in the followings.

The developer 24 including the corrected toner on the toner-collecting developer supporting member 26 is conveyed in the direction to the developer tank 16 with the rotation of the sleeve 27 and is stripped from the toner-collecting developer supporting member 26 by the repelling magnetic field of the homopolar section N6 and N4 of the magnetic roller 28 and then collected into the developer tank 16.

Based on the output signal from the ATDC sensor 20, when the replenishment control section (not shown) detects that the toner density in the developer 24 is less than the minimum toner density needed for attaining image density, the replenishing toner 23 stored in the hopper is supplied by a toner replenishing means (not shown) into the development tank 16 through the toner replenishing section 10.

It is to be noted that the flow of the developer in this example of the structure and operation of the developing device 2*a* is as follows.

The toner-supplying developer supporting member 11 and the toner-collecting developer supporting member 26 are arranged opposing each other, and the developer 24 is supplied from the development tank 16 onto the toner-supplying developer supporting member 11, after being regulated on the toner-supplying developer supporting member 11, is transferred from the toner-supplying developer supporting member 11 onto the toner-collecting developer supporting member 26, and then is separated from the toner-collecting developer supporting member 26 to be returned to the developer tank 16.

It is to be noted, however, that the flow of the developer 24 is not limited to the flow described above.

For example, the developer 24 may be transferred back from the toner-collecting developer supporting member 26 onto the toner-supplying developer supporting member 11 and be returned from the toner-supplying developer supporting member 11 into the developer tank 16.

In addition, the developer 24 may be supplied to the toner-supplying developer supporting member 11 and the toner-collecting developer supporting member 26, and may be conveyed, after the amount being regulated, to the toner supply region 7 and the toner collection region 8 respectively, then may be separated from the respective developer supporting members and returned to the developer tank 16. (The flows of the developer on the toner-supplying developer supporting member 11 and the toner-collecting developer supporting member 26 are independent of each other).

That is to say, no particular limitation is imposed on the flow provided that the toner density of the developer 24 conveyed to the toner supply region 7 is adjusted in the developer tank 16.

(Problems at the Toner Collection Region and Setting of Collection Conditions)

The relationship between toner collecting capability at the toner collection region and the collection conditions such as bias setting will be described in detail in the followings.

In the conventional arts, a development bias was applied to the toner supporting member 25 at the toner collection region 8, toner collection bias was applied to the toner-collecting developer supporting member 26, and a collection electric field was thus formed. The post-development residual toner was transferred, by this collection electric field, from the toner supporting member 25 onto the toner-collecting developer supporting member to be collected.

However, when the collection electric field is strong, the toner in the developer (bristle) is separated from the carrier in the collection region 8, and toner is transferred to the surface of the toner-collecting developer supporting member 26, and the uneven distribution of the toner to the surface occurs.

When the toner is separated form the carrier and unevenly distributed to the surface of the toner-collecting developer supporting member 26, the unevenly distributed toner remains, as described later, on the surface of the toner-collecting developer supporting member if the developer 24 is removed from the toner-collecting developer supporting member 26. Accordingly, toner accumulates on the toner-collecting developer supporting member 26 in long time use.

The accumulation of charged toner decreases the collection electric field in the toner collection region 8 and causes a reduction in toner collecting capability. Because of this, the collecting capability of the post-development residual toner is not sustained over a long period, and thus the problem of ghost-image generation develops with repeated image formation.

In contrast, in the embodiment, in order to prevent toner from being unevenly distributed to the surface of the toner-collecting developer supporting member 26 caused by the collection electric field in the toner collection region 8, as in the case of the toner supply region 7, an electric field in the direction in which the toner moves from the toner-collecting developer supporting member 26 to the toner supporting member 25, or in other words, the supply direction, is formed as the collection electric field.

In this embodiment, although the toner-collecting developer supporting member 26 is applied with a bias in the direction in which the toner is supplied to the toner supporting member 25 in order to prevent toner from being unevenly distributed, it does not need to have a function for supplying the toner. Therefore, it is possible to set conditions in the toner collection region 8 putting a priority on collecting toner, regardless of the conditions at the toner supply region 7, such that the toner collecting capability is high.

Thus, in the embodiment, in the following manner, the toner collecting capability is increased, and sufficient ability to collect the post-development residual toner is obtained, and the problem of ghost-image generation is solved.

(a) The bias is set such that the voltage of the toner-collecting developer supporting member in reference to the toner supporting member has the same polarity as and a smaller absolute average value than the voltage of the toner-supplying developer supporting member in reference to the toner supporting member.

That is to say, the direction of the electric field for the toner supporting member is the same (toner supply direction) in the toner supply region and in the toner collection region, and therefore this is equivalent to the following bias setting.

The difference between the average value of the development bias applied to the toner supporting member and the average value of the toner collection bias applied to the toner-collecting developer supporting member is set to be smaller than the difference between the average value of the development bias applied to the toner supporting member and the average value of the toner supply bias applied to the toner-supplying developer supporting member. That is to say, the bias is set such that the force to move toner from the toner-collecting developer supporting member to the toner-supporting member is smaller than the force to move toner from the toner-supplying developer supporting member to the toner-supporting member.

The following means is also effective for increasing the toner collecting capability.

(b) The biases are set such that the amplitude of the alternating current electric field formed in the opposing section (toner collection region) between the toner supporting member and the toner-collecting developer supporting member is larger than the amplitude of the alternating current electric field formed in the opposing section (toner supply region) between the toner supporting member and the toner-supplying developer supporting member.

That is to say, the biases to be applied to the toner-collecting developer supporting member and the toner-supplying developer supporting member are set such that the amplitude of the alternating current electric field of the toner collection region is larger than the amplitude of the alternating current electric field of the toner supply region.

It is believed that the post-development residual toner on the toner supporting member 25 is collected onto the toner-collecting developer supporting member 26 by the mechanical friction force of the bristle of the developer 24 caused by the magnetic force of the primary magnetic pole S3 of the toner-collecting developer supporting member 26.

It is thought that both the aforementioned (a) and (b) promote collection of the post-development residual toner from the toner supporting member 25 by reducing the electrostatic force, in order to prevent the toner from disturbing the mechanical collection, that moves the toner in the developer from the toner-collecting developer supporting member 26 to the toner supporting member 25.

By setting the collection conditions in accordance with the methods of (a) and (b) above, an electric field is formed at the toner collection region 8 in the direction in which the toner is supplied, and uneven distribution to the toner-collecting developer supporting member 26 is avoided, while the necessary and sufficient toner-collecting capability for the post-development residual toner is secured and generation of ghost images is reduced.

Figure 2:
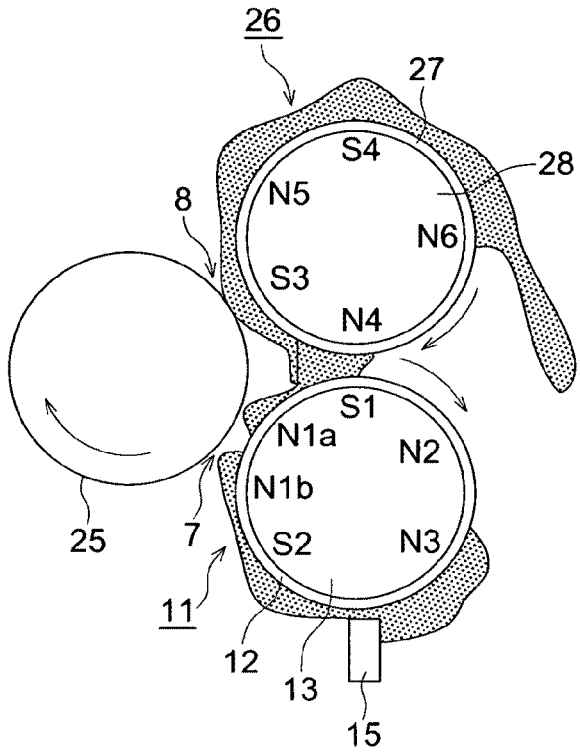
FIG. 2 is a drawing showing a cross-section of an aspect of the developing device 2*a* in which a homopolar portion is provided in the toner-supplying developer supporting member of FIG. 1.

FIG. 2 shows an example of the structure of the main part of the developing device in which two homopolar magnetic poles are provided instead of the primary magnetic pole Ni which is in the toner-supplying developer supporting member of FIG. 1.

In a manner such as (a), in the case where the average value of the toner collection bias is made different from that of the toner supply bias and the collecting capability is increased, it is more preferable that two homopolar magnetic poles N1*a* and N1*b* are used instead of the primary magnetic pole N1 of the toner-supplying developer supporting member 11.

The reason for doing this is that by using homopolar magnetic poles which have high toner supply ability, the toner of required amount can be supplied by a comparatively low toner supply bias. Which means that if the toner supply bias is set to be comparatively low, the electric potential between the toner-supplying developer supporting member 11 and the toner-collecting developer supporting member 26 can be small while a good compromise is kept between a sufficient toner supply amount and collecting capability that does not cause ghost-image generation.

By setting the electric potential difference small, regardless of the environment of use, it is possible to avoid the following problems: a current leakage between the toner-supplying developer supporting member 11 and the toner-collecting developer supporting member 26; and uneven distribution of toner to the toner-collecting developer supporting member 26 caused by the electric field between the toner-supplying developer supporting member 11 and the toner-collecting developer supporting member 26.

The reason why the homopolar magnetic poles enhance the toner supply ability is thought that a portion where the bristle of carrier is sparse and the toner can move freely appears between the poles, and thus toner clouds are easy to be activated. In addition, it is also thought as the reason that the region where the carrier and the toner supporting member contact each other is substantially greater than in the case of one pole.

The distance between the toner-supplying developer supporting member 11 and the toner-collecting developer supporting member 26 usually can be set greater than that between the toner supporting member 25 and the toner-collecting developer supporting member 26 provided that the transfer of developer can be carried out smoothly. As a result, the electric field between the toner-supplying developer supporting member 11 and the toner-collecting developer supporting member 26 actually is not so strong, and occurrence of leakage and uneven distribution of toner unlikely occurs. However, this electric field is preferably set as low as possible when the possibility of current leakage in a high temperature and high humidity environment, and uneven distribution of toner due to increased toner charge in a low temperature and low humidity environment is considered.

(Structure and Operation of the Developing Device 2*b*)

Figure 3:
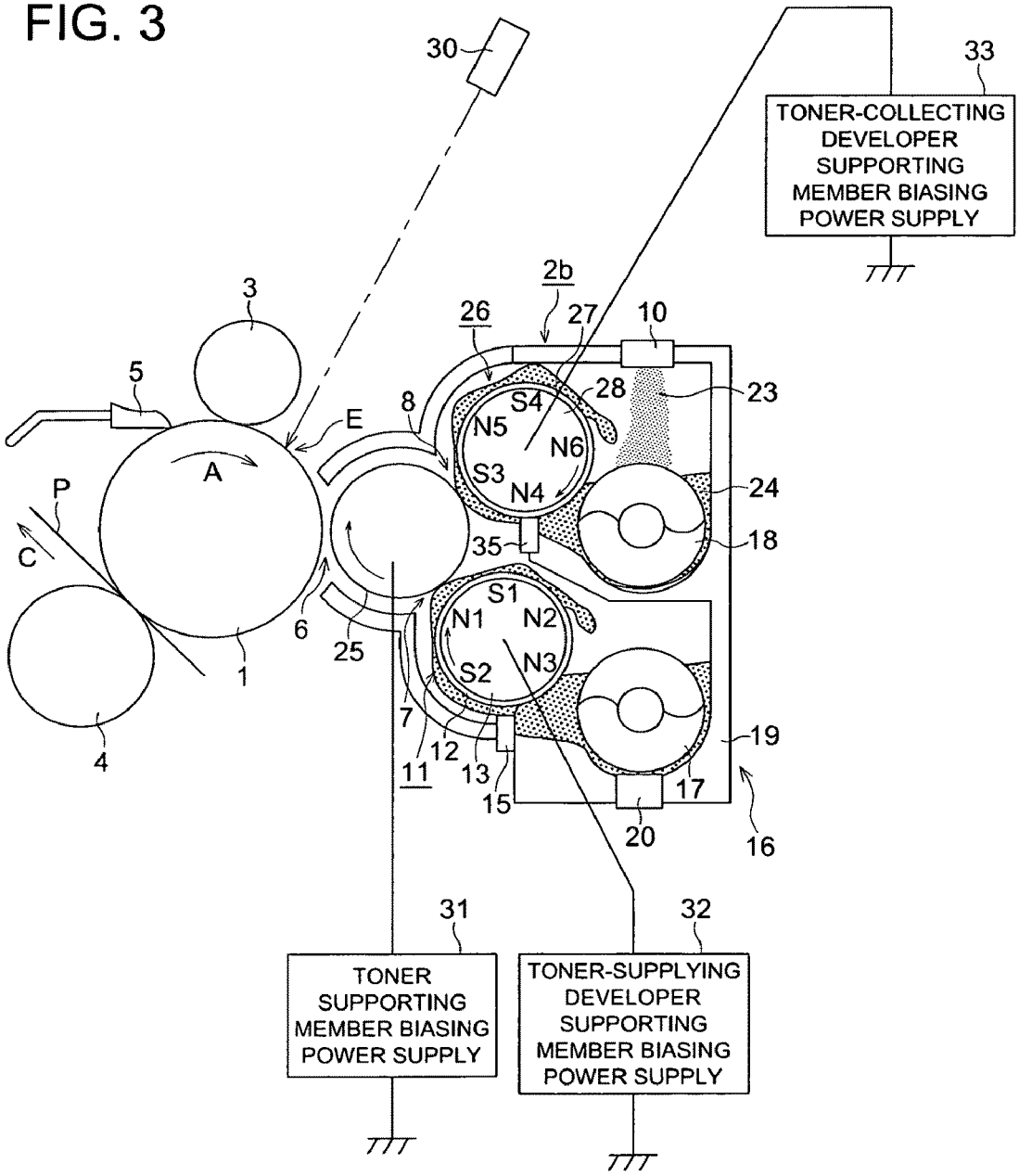
FIG. 3 is a diagram showing a cross-section of an example of the structure of the main part of a developing device 2*b* according to the second embodiment of the present invention and the image forming apparatus including the developing device 2*b*.

Next, an example of the structure of the main part of a developing device 2*b* according to the second embodiment of the present invention is shown in FIG. 3. In FIG. 3, the parts that carry out the same operations as those in FIG. 1 will be assigned the same reference numbers and repeated descriptions thereof will be omitted.

An example of the structure and the operation of the developing device 2*b* according the second embodiment will be described with reference to FIG. 3.

In the developing device 2*b*, a toner-supplying developer supporting member 11 and a toner-collecting developer supporting member 26 are provided with regulation members 15 and 35 respectively, and the developer 24 is not transferred between the toner-supplying developer supporting member 11 and the toner-collecting developer supporting member 26.

In the developing device 2*b*, a magnetic roller 13 inside the toner-supplying developer supporting member 11 includes five magnetic poles N1, S1, N2, N3, and S2 in the direction of rotation of a sleeve roller 12. Of these magnetic poles, the primary magnetic pole N1 is arranged at the position corresponding to a toner supply region 7 where the toner-supplying developer supporting member opposes the toner supporting member 25.

The homopolar sections N2 and N3 which generate repelling magnetic fields for stripping the developer 24 on the surface of the sleeve roller 12 are arranged facing the inside of the developer tank 16. The homopolar sections N2 and N3 cause the developer 24 to separate from the toner-supplying developer supporting member 11 and to be collected in the development tank 16.

Similarly, a magnetic roller 28 inside the toner-collecting developer supporting member includes five magnetic poles N4, S3, N5, S4, and N6 in the direction of rotation of a sleeve roller 27. Of these magnetic poles, the primary magnetic pole S3 is arranged at the position corresponding to the toner collection region 8 where the toner-collecting developer supporting member 26 opposes the toner supporting member 25.

The homopolar sections N6 and N4 which generate repelling magnetic fields for stripping the developer 24 on the surface of the sleeve roller 27 are arranged facing the inside of the developer tank 16.

This arrangement makes it possible to cause the toner-supplying developer supporting member 11 and the toner-collecting developer supporting member 26 to convey different amount of developer, or to cause the both members to convey the same amount of developer even if the circumferential speeds of the toner-supplying developer supporting member 11 and the toner-collecting developer supporting member 26 are different.

Thus, in order to increase the collecting capability in the toner collecting region 8, the following manners (c) and (d) can be employed in addition to (a) and (b) described in the previous embodiment.

(a) The bias is set such that the average value of the electric potential difference between the toner-collecting developer supporting member and the toner supporting member is smaller than the average value of the electric potential difference between toner-supplying developer supporting member and the toner supporting member. That is to say, the bias is set such that the force to move toner from the toner-collecting developer supporting member to the toner-supporting member is smaller than the force to move toner from the toner-supplying developer supporting member to the toner-supporting member.

(b) The biases are set such that the amplitude of the alternating current electric field formed in the toner collection region is larger than the amplitude of the alternating current electric field formed in the toner supply region.

(c) The relative circumferential speed between the toner supporting member and the toner-collecting developer supporting member in the toner collection region is greater than the relative circumferential speed between the toner supporting member and the toner-supplying developer supporting member in the toner supply region.

(d) The PD (packing density), which is an occupancy of developer occupying the space between the two members, in the toner collection region is set to be larger than the PD of the toner supply region. PD is represented by the following formula.

$$PD=M/(\rho\times Dss);$$

wherein:

M ($g/m^2$) is the amount of developer per unit area on the developer supporting member;

Dss (m) is the closest distance between the supporting members; and

ρ ($g/m^3$) is the density of the developer.

In order to increase the PD, the developer amount may be increased or the closest distance between the supporting members may be decreased. For example, the regulation member 35 may be adjusted such that the toner-collecting developer supporting member 26 conveys more developer than the toner-supplying developer supporting member 11.

In the manners (a) and (b), the electrostatic force to move the toner in the developer onto the toner supporting member 25 is decreased not to prevent the toner from being mechanically collected by rubbing of the developer bristle, and collection of the post-development residual toner from the toner supporting member 25 is thus promoted.

On the other hand, the manners (c) and (d) increase rubbing force in the toner collection region or increase the developer amount both in order to increase the mechanical collection force, and thereby promoting collection.

By setting the collection conditions in accordance with with the above-mentioned manners (c) or (d) besides the manners (a) and (b), the necessary and sufficient toner-collecting capability is secured while the uneven distribution of toner to the surface of the toner-collecting developer supporting member 26 is reduced by forming the electric field in the toner-supplying direction in the toner collection region. As a result, the occurrence of ghost images is reduced.

According to the embodiment of the present invention, collection of the post-development residual toner on the toner supporting member by the toner-collecting developer supporting member is secured, and accumulation of the toner on the toner-collecting developer supporting member is avoided. Thus, a uniform toner layer is stably provided on the toner supporting member.

As a result, a developing device and image forming apparatus is supplied, wherein the toner collecting capability is long sustained, and high quality images are obtained with the ghost image problem alleviated over a long period.

WORKING EXAMPLES

The followings are the results obtained by experiments conducted using the developing device according to the above-described embodiment in order to confirm the advantages thereof.

The developing devices having a structure corresponding to the development devices 2*a* and 2*b* were prepared and used.

The image forming apparatus used was prepared by modifying the bizhubC350, which is a MFP manufactured by Konica Minolta Business Technologies Co., Ltd., by installing the developing device 2*a* or 2*b* shown in FIG. 1 or FIG. 3. The developer used was also developer for the bizhubC350. The toner polarity is negative, and the toner density of the developer was 8%.

In each of the developing devices, the development gap between the image supporting member and the toner supporting member was 0.15 mm. The toner supply gap between the toner supporting member and the toner-supplying developer supporting member and the toner collection gap between the toner supporting member and the toner-collecting developer supporting member were both 0.35 mm.

The voltage applied to the toner supporting member has a rectangular waveform with an amplitude of 1.4 kV peak-to-peak, a DC component of −300 V, a frequency of 4 kHz and a duty ratio of 50%.

The voltages applied to the toner-supplying developer supporting member and the toner-collecting developer supporting member are specified in the working examples and the comparative examples below.

The background portion potential of the electrostatic latent image formed on the image supporting member is −550 V while the image portion potential is −60 V.

In each of the working examples and comparative examples described below, 100 sheets of the chart shown in FIG. 4 were printed continuously using the aforesaid image forming apparatus, and generation of development hysteresis (ghost image) on the 1st sheet was compared with that on the 100th sheet.

Figure 4:
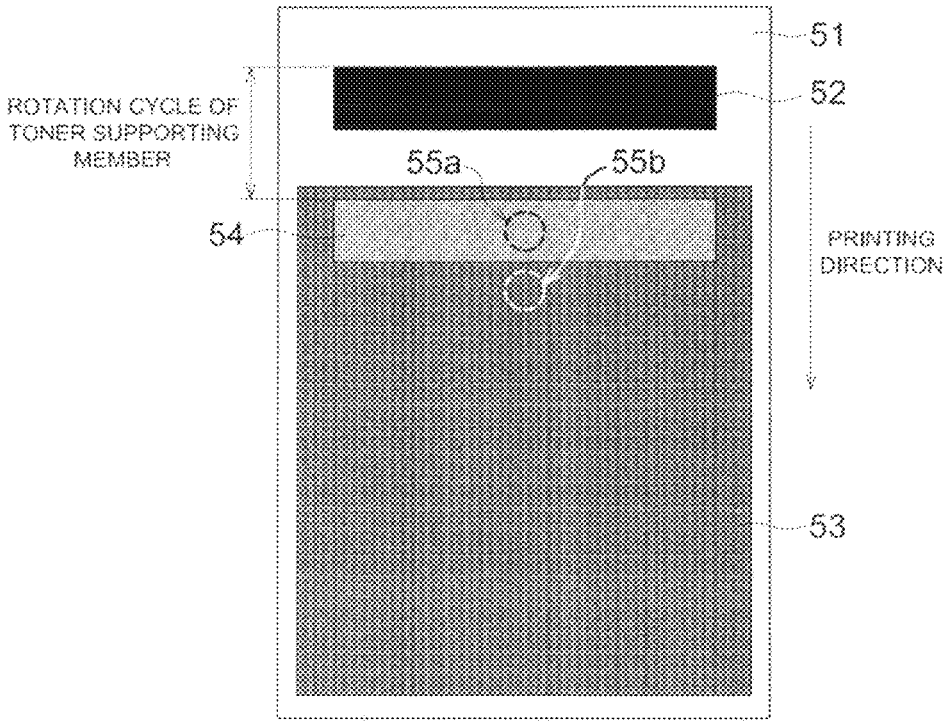
FIG. 4 is a diagram showing a chart for the evaluation of development hysteresis. In addition, it illustrates an example of ghost image.

In the chart of FIG. 4, reference numeral 51 is a white portion, 52 is a solid black portion, and 53 is an intermediate density portion. There is a large difference between the amounts of post-development residual toner generated in the regions corresponding to the white portion 51 and the solid black portion 52. Thus, if the post-development residual toner is not collected and resides, the residual toner affects an image (ghost image) at the time of development after one cycle of the rotation of the toner supporting member particularly in the intermediate image region.

The reference numeral 54 in the chart of FIG. 4 is an example of the generation of a ghost image, where a pattern which does not exist in the chart is formed as a ghost image. The region which is lighter (because of a smaller toner amount) than the intermediate image portion is generated at the position corresponding to the position one cycle after the solid black portion 52.

The evaluation of development hysteresis (ghost-image generation) was done by measuring the density of the regions corresponding to the solid black portion and the white portion (55*a* and 55*b*) of the printed half image by using a densitometer (X-rite 310 manufactured by X-rite), and if the difference in density was 0.1 or less, a grade A was given, and if it is greater than that, a grade B was given.

In addition, in order to check whether uneven distribution of toner has occurred on the surface of the toner-collecting developer supporting member, the developing device was removed and the surface potential of the toner which was not separated from the supporting member along with carrier and is attached to the surface between the N4 and N6 poles was measured after 100 sheets were complete.

The surface electrometer Model 344 manufactured by TREK was used to measure the surface potential in a state where the toner-collecting developer supporting member was grounded.

Working Example 1

The developing device shown in FIG. 1 was used and a direct current voltage of −500 V is applied to the toner-supplying developer supporting member and a direct current voltage of −400 V is applied to the toner-collecting developer supporting member. The amount of developer conveyed on the developer supporting member was 200 g/m$^2$.

Working Example 2

A direct current voltage of −500 V is applied to the toner-supplying developer supporting member, and a direct current voltage of −500 V superimposed to an alternating voltage with a frequency of 4 kHz and a phrase opposite to that of the alternating current voltage of the toner supporting member was applied to the toner-collecting developer supporting member.

At this time, the peak to peak amplitude of the alternating component of the voltage that was applied in the toner collection region as bias was 2000 V. The amount of the developer conveyed on the developer supporting member was 200 g/m$^2$.

ing developer supporting member was also applied with a direct current voltage of −500 V. The amount of developer conveyed on the developer supporting member was 200 g/m$^2$.

Comparative Example 2

The developing device shown in FIG. 1 was used. The toner-supplying developer supporting member was applied with a direct current voltage of −500 V, and the toner-collecting developer supporting member was applied with a direct current voltage of −200 V. The amount of developer conveyed onto the developer supporting member was 200 g/m$^2$.

(Evaluation Results)

The evaluation results of Working Examples 1-4 and Comparative Examples 1-2 are shown in Table 1.

TABLE 1

| | Supply ΔVave (V) | Collection ΔVave (V) | Supply Vpp (V) | Collection Vpp (V) | Supply θ | Collection θ | Supply M/S (mg) | Collection M/S (mg) | Ghost on 1st sheet | Ghost on 100th sheet | Surface potential (V) |
|---|---|---|---|---|---|---|---|---|---|---|---|
| **1 | −200 | −100 | 1400 | 1400 | 1.2 | 1.2 | 200 | 200 | A | A | −5.4 |
| **2 | −200 | −200 | 1400 | 2000 | 1.2 | 1.2 | 200 | 200 | A | A | −3.7 |
| **3 | −200 | −200 | 1400 | 1400 | 1.2 | 2.0 | 200 | 200 | A | A | −5.2 |
| **4 | −200 | −200 | 1400 | 1400 | 1.2 | 1.2 | 200 | 300 | A | A | −5.2 |
| Comp. 1 | −200 | −200 | 1400 | 1400 | 1.2 | 1.2 | 200 | 200 | B | B | −3.5 |
| Comp. 2 | −200 | 100 | 1400 | 1400 | 1.2 | 1.2 | 200 | 200 | A | B | −256 |

**Working example,
Comp.: Comparative example

Working Example 3

The developing device shown in FIG. 3 is used. The toner-supplying developer supporting member was applied with a direct current voltage of −500 V, and the toner-collecting developer supporting member was also applied with a direct current voltage of −500 V.

The circumferential speed of the toner-collecting developer supporting member was set to be 2.0 times that of the toner supporting member. The amounts of developer conveyed on the developer supporting members were 200 g/m$^2$.

Working Example 4

The developing device shown in FIG. 3 was used. The toner-supplying developer supporting member was applied with a direct current voltage of −500 V, and the toner-collecting developer supporting member was also applied with a direct current voltage of −500 V.

The gaps between the regulation members opposing the toner-collecting developer supporting member and the toner-collecting developer supporting member were adjusted to control the conveying amounts of the developer to be 300 g/m$^2$.

Comparative Example 1

The developing device shown in FIG. 1 was used. The toner-supplying developer supporting member was applied with a direct current voltage of −500 V, and the toner-collect- In the table "Supply ΔVave" represents the value obtained by subtracting the average value of the voltage applied to the toner supporting member (−300 V for all the examples) from the average value of the voltage applied to toner-supplying developer supporting member (−500 V for all the examples). "Collection ΔVave" represents the value obtained by subtracting the average value of the voltage applied to the toner supporting member (−300 V) from the average value of the voltage applied to toner-collecting developer supporting member (the settings individually differ).

"Supply Vpp" represents the peak-to-peak alternating current component of the voltage applied as the toner supply bias, and "Collection Vpp" represents the peak-to-peak alternating current component of the voltage applied as the toner collection bias.

"Supply θ" and "Collection θ" present the speed ratio of the toner supporting member to each of the developer supporting members in the toner supply region and the toner collection region, respectively.

"Supply M/S" and "Collection M/S" represent the amounts of the developer conveyed on the toner-supplying developer supporting member and the toner-collecting developer supporting member, respectively.

"Ghost image on 1st sheet" is the evaluation grade, judged by the standards described above, of the ghost-image generated on the 1st sheet, and "Ghost image on 100th sheet" is the evaluation grade, judged by the standards described above, of the ghost-image generated on the 100th sheet.

"Surface Potential" is the measured surface potential between N4 and N6 on the surface of the toner-collecting developer supporting member after printing 100 sheets.

The evaluation results of Working Examples 1-4 and Comparative Examples 1-2 in Table 1 will be compared in the followings.

In Working Example 1, there was no generation of ghost images on the sheet from the 1st to 100th, and even after printing 100 sheets, little or no uneven distribution of toner occurred on the surface of the toner-collecting developer supporting member.

On the other hand, in the Comparative Example 1, collecting capability was insufficient and ghost-image generation occurred from the 1st sheet.

In Comparative Example 2, collecting capability was good for the 1st sheet, and there was no ghost-image generated. However, there was ghost-image generated on the 100th sheet.

It is believed that this occurred because the uneven distribution of toner of exceeding −200 V was found on the surface of the toner-collecting developer supporting member after printing 100 sheets, and the uneven distribution disturbed the collection electric field, so that collecting capability was insufficient and a ghost-image is generated.

As described above, in working Example 1 the effect on the toner collecting capability due to the appropriate bias setting is apparent with respect to the comparative examples.

In Working Example 2, there was no ghost-image generated on the sheet from the 1st to the 100th either, and even after printing of 100 sheets, little uneven distribution of toner occurred on the surface of the toner-collecting developer supporting member. The effect, of the appropriate setting of amplitude of the alternating bias component, on the toner collecting capability is apparent with respect to the comparative examples.

In Working Example 3, there was no ghost-image generated on the sheet from the 1st to the 100th either, and even after printing 100 sheets, little uneven distribution of toner occurred on the surface of the toner-collecting developer supporting member. The effect, of appropriate setting of the relative circumferential speed, on the toner collecting capability is apparent with respect to the comparative examples.

In Working Example 4, there was no ghost-image generated on the sheet from the 1st to the 100th either, and even after printing 100 sheets, little uneven distribution of toner occurred on the surface of the toner-collecting developer supporting member. The effect, of appropriate developer conveying amount (or PD), on the toner collecting capability is apparent with respect to the comparative examples.

As described above, in the developing device and image forming apparatus of the embodiment, collection of the post-development residual toner on the toner supporting member by the toner-collecting developer supporting member is ensured, and accumulation of the toner on the toner-collecting developer supporting member is reduced, and thus a uniform toner layer is stably provided on the toner supporting member. As a result, the toner collecting capability is sustained for long time, and high quality images with out ghost-image are obtained over a long period.

It is to be noted that all the features of the above embodiments are just examples and are not intended to limit the invention. The scope of the present invention is not defined by the above descriptions, but rather by the scope of the claims, and includes any modification which has the meaning and within the scope both equivalent to the claims of the present invention.

What is claimed is:

1. A developing device, comprising:

a developer container for containing developer including toner and carrier;

a toner-supplying developer supporting member for supporting on a surface thereof, the developer in the developer container to convey the developer;

a toner supporting member for supporting toner received from the toner-supplying developer supporting member and conveying the toner to develop an electrostatic latent image on an image supporting member;

a toner-collecting developer supporting member for collecting a post-development residual toner from the toner supporting member;

a first bias power supply for applying a first bias voltage to the toner-collecting developer supporting member to form a first bias electric field between the toner-collecting developer supporting member and the toner supporting member in a direction in which toner is transferred to the toner supporting member; and a second bias power supply for applying a second bias voltage to the toner-supplying developer supporting member to form a second bias electric field between the toner-supplying developer supporting member and the toner supporting member in a direction in which toner is transferred to the toner supporting member, wherein an average of a voltage of the toner-collecting developer supporting member in reference to the toner supporting member has the same polarity as and a smaller absolute value than an average of a voltage of the toner-supplying developer supporting member in reference to the toner supporting member, and wherein a toner collecting capability for the toner-collecting developer supporting member to collect toner from the toner supporting member is higher than a toner collecting capability for the toner-supplying developer supporting member to collect toner from the toner supporting member.

2. The developing device of claim 1, wherein a relative circumferential speed between the toner-collecting developer supporting member and the toner supporting member at opposing position therebetween is greater than a relative circumferential speed between the toner-supplying developer supporting member and the toner supporting member at an opposing position therebetween.

3. The developing device of claim 1, wherein PD1 at an opposing position between the toner-collecting developer supporting member and the toner supporting member is greater than PD2 at an opposing position between the toner-supplying developer supporting member and the toner supporting member, wherein the PD1 and the PD2 denote an occupancy of developer occupying a space between the toner-collecting developer supporting member and the toner supporting member and an occupancy of developer occupying a space between the toner-supplying developer supporting member and the toner supporting member respectively, and the PD1 and the PD2are defined by the following equations:

$$PD1=M1/(\rho\times Dss1);$$

and $$PD2=M2/(\rho\times Dss2),$$

wherein:

M1 ($g/m^2$) is an amount of developer per unit area at the opposing position between the toner-collecting developer supporting member and the toner supporting member;

M2 ($g/m^2$) is an amount of the developer per unit area at the opposing position between the toner-supplying developer supporting member and the toner supporting member;

Dss1 (m) is a closest distance between the toner-collecting developer supporting member and the toner supporting member;

Dss2 (m) is a closest distance between the toner-supplying developer supporting member and the toner supporting member; and $\rho(g/m^3)$ is a density of the developer.

4. The developing device of claim 1, wherein the toner-supplying developer supporting member includes:

a magnetic roller provided fixedly; and a rotatable sleeve roller which contains the magnetic roller therein, wherein two magnetic poles having the same polarity are arranged on the magnetic roller at a position in which the magnetic roller faces the toner supporting member.

5. A developing device, comprising:

a developer container for containing developer including toner and carrier;

a toner-supplying developer supporting member for supporting on a surface thereof, the developer in the developer container to convey the developer;

a toner supporting member for supporting toner received from the toner-supplying developer supporting member and conveying the toner to develop an electrostatic latent image on an image supporting member;

a toner-collecting developer supporting member for collecting a post-development residual toner from the toner supporting member;

a first bias power supply for applying a first bias voltage to the toner-collecting developer supporting member to form a first bias electric field between the toner-collecting developer supporting member and the toner supporting member in a direction in which toner is transferred to the toner supporting member; and a second bias power supply for applying a second bias voltage to the toner-supplying developer supporting member to form a second bias electric field between the toner-supplying developer supporting member and the toner supporting member in a direction in which toner is transferred to the toner supporting member, wherein a toner collecting capability for the toner-collecting developer supporting member to collect toner from the toner supporting member is higher than a toner collecting capability for the toner-supplying developer supporting member to collect toner from the toner supporting member, and wherein the first bias voltage and the second bias voltage are applied such that the first bias electric field and the second bias electric field each include an alternative electric field, and the first bias electric field has a greater amplitude than the second bias electric field.

6. An image forming apparatus, comprising:

an image supporting member for supporting an electrostatic latent image thereon; and an developer container for containing developer including toner and carrier;

a toner-supplying developer supporting member for supporting on a surface thereof the developer in the developer container to convey the developer;

a toner supporting member for supporting toner received from the toner-supplying developer supporting member and conveying the toner to develop an electrostatic latent image on the image supporting member;

a toner-collecting developer supporting member for collecting a post-development residual toner from the toner supporting member;

a first bias power supply for applying a first bias voltage to the toner-collecting developer supporting member to form a first bias electric field between the toner-collecting developer supporting member and the toner supporting member in a direction in which toner is transferred to the toner supporting member; and a second bias power supply for applying a second bias voltage to the toner-supplying developer supporting member to form a second bias electric field between the toner-supplying developer supporting member and the toner supporting member in a direction in which toner is transferred to the toner supporting member, wherein an average of a voltage of the toner-collecting developer supporting member in reference to the toner supporting member has the same polarity as and a smaller absolute value than an average of a voltage of the toner-supplying developer supporting member in reference to the toner supporting member, and a toner collecting capability for the toner- collecting developer supporting member to collect toner from the toner supporting member is higher than a toner collecting capability for the toner-supplying developer supporting member to collect toner from the toner supporting member.

* * * * *